US011078648B2

(12) United States Patent
Knowles

(10) Patent No.: US 11,078,648 B2
(45) Date of Patent: Aug. 3, 2021

(54) GRADE CONTROL FOR MACHINES WITH BUCKETS

(71) Applicant: Caterpillar Inc., Deerfield, IL (US)

(72) Inventor: Jason Knowles, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 292 days.

(21) Appl. No.: 16/283,137

(22) Filed: Feb. 22, 2019

(65) Prior Publication Data

US 2020/0270848 A1 Aug. 27, 2020

(51) Int. Cl.

| | |
|---|---|
| ***E02F 3/40*** | (2006.01) |
| ***E02F 9/26*** | (2006.01) |
| ***E02F 3/43*** | (2006.01) |
| ***E02F 3/28*** | (2006.01) |
| ***E02F 9/20*** | (2006.01) |

(52) U.S. Cl.

CPC ..... *E02F 9/265* (2013.01); *E02F 3/283* (2013.01); *E02F 3/432* (2013.01); *E02F 9/2041* (2013.01); *E02F 9/262* (2013.01)

(58) Field of Classification Search

CPC ..... E02F 9/26; E02F 3/76; E02F 3/308; E02F 3/432; E02F 3/3405; E02F 3/3411; E02F 9/2883; E02F 9/2004; E02F 9/4317; E02F 3/3417; A01B 63/24; A01B 69/00; F04C 19/00; B25J 9/16; B61D 1/04; A01C 5/04; A01D 45/00; B66F 9/22

See application file for complete search history.

(56) References Cited

U.S. PATENT DOCUMENTS

| | | | | | |
|---|---|---|---|---|---|
| 2,290,477 | A * | 7/1942 | Magee | E02F 3/7613 | 172/818 |
| 2,790,256 | A * | 4/1957 | Beyerstedt | E02F 3/3411 | 37/408 |
| 2,817,448 | A * | 12/1957 | Pilch | E02F 3/3411 | 414/713 |
| 2,965,253 | A * | 12/1960 | Poulter | E02F 3/308 | 414/694 |
| 3,199,604 | A * | 8/1965 | Coby | A01D 45/006 | 171/27 |
| 4,616,712 | A * | 10/1986 | Jorgensen | A01B 69/004 | 104/244.1 |
| 4,682,659 | A * | 7/1987 | Holopainen | A01C 5/04 | 173/27 |

(Continued)

FOREIGN PATENT DOCUMENTS

| | | | | |
|---|---|---|---|---|
| CA | 2885399 | A1 | 9/2016 | |
| EP | 2924178 | A2 * | 9/2015 | E02F 3/432 |
| KR | 20120052443 | A | 5/2012 | |

*Primary Examiner* — Yuri Kan

(57) ABSTRACT

A method is disclosed. The method may include controlling a leading edge of an implement of a machine using a first control loop to cause the implement to align to a defined design plan; controlling a trailing edge of the implement of the machine using a second control loop to cause the implement to align to the defined design plan; and selectively altering a gain to the second control loop based on a detected deviation of the implement from the defined design plan to increase an angle of approach, using the first control loop, when the implement is positioned above the defined design plan and decrease the angle of approach, using the first control loop, when the implement is aligned to the defined design plan.

20 Claims, 5 Drawing Sheets

(56) References Cited

U.S. PATENT DOCUMENTS

| | | | | |
|---|---|---|---|---|
| 5,169,278 | A * | 12/1992 | Hoechst | E02F 3/3405 414/685 |
| 5,501,570 | A * | 3/1996 | Mozingo | E02F 3/432 414/700 |
| 6,604,752 | B1 * | 8/2003 | Gerres | B60D 1/04 280/415.1 |
| 2014/0119869 | A1 * | 5/2014 | France | E02F 3/3417 414/715 |
| 2014/0119955 | A1 * | 5/2014 | Shenoi | F04C 19/004 417/68 |
| 2016/0273196 | A1 | 9/2016 | Funk et al. | |
| 2018/0126553 | A1 * | 5/2018 | Corkum | B25J 9/1697 |
| 2018/0346301 | A1 * | 12/2018 | Myers | B66F 9/22 |
| 2019/0119886 | A1 * | 4/2019 | Izumi | E02F 9/2004 |
| 2019/0317052 | A1 * | 10/2019 | Plouzek | E02F 9/2883 |
| 2020/0068779 | A1 * | 3/2020 | Barker | A01C 7/201 |

* cited by examiner

GRADE CONTROL FOR MACHINES WITH BUCKETS

TECHNICAL FIELD

The present disclosure relates generally to grade control and, more particularly, to grade control for machines with buckets.

BACKGROUND

A machine, such as a track-type loader, may include a transmission coupled to a power source, such as an internal combustion engine to enable the track-type loader to be repositioned and/or to travel between locations. Additionally, the track-type loader may include one or more articulated implements to perform one or more functions. For example, the track-type loader may include a bucket implement to perform an excavation function, a grading function, and/or the like.

The bucket may connect to the track-type loader via a boom, which may include a raise/lower function, a rack/dump function, and/or the like to articulate the bucket. To maintain the bucket in alignment with a design plan, an operator may control the raise/lower function and the rack/dump function. However, when the bucket is positioned above the design plan such that a bottom surface of the bucket is approximately parallel with the design plan, articulating the bucket to align with the design plan may be difficult. For example, as a result of the bottom surface of the bucket being relatively large, the bucket may be unable to penetrate hard-packed ground when being lowered toward the design plan.

One attempt to control a bucket implement is disclosed in U.S. Patent Application Publication No. 2016/0273196 that published to Funk, et al. on Sep. 22, 2016 ("the '196 publication"). In particular, the '196 publication discloses an "an automatic leveling control system . . . to adjust at least one of a height of the lift arms and the tilt angle of the work attachment mounting structure such that a grading edge of the work attachment is maintained at elevation as the machine is propelled about the worksite." However, while the '196 publication may use the automatic leveling control system to enable the machine to be propelled about the worksite, the '196 publication may not independently control different points on the work attachment to enable the work attachment to be returned to alignment with a design plan and to level an angle of the work attachment once the work attachment is aligned to the design plan.

The grading control system of the present disclosure solves one or more of the problems set forth above and/or other problems in the art.

SUMMARY

According to some implementations, the present disclosure is related to a method. The method may include controlling, by a device, a leading edge of an implement of a machine using a first control loop to cause the implement to align to a defined design plan; controlling, by the device, a trailing edge of the implement of the machine using a second control loop to cause the implement to align to the defined design plan; and selectively altering, by the device, a gain to the second control loop based on a detected deviation of the implement from the defined design plan to increase an angle of approach, using the first control loop, when the implement is positioned above the defined design plan and decrease the angle of approach, using the first control loop, when the implement is aligned to the defined design plan.

According to some implementations, the present disclosure is related to a system including one or more memories and one or more processors communicatively coupled to the one or more memories. The one or more memories and the one or more processors may be configured to determine a position of a leading edge of an implement of a machine; determine a position of a trailing edge of the implement of the machine; determine, based on the position of the leading edge and the position of the trailing edge, a deviation from a design plan defining a grade for the implement of the machine; control the leading edge of the implement and suppress control of the trailing edge of the implement to increase a first angle of approach of the implement; determine, after controlling the leading edge of the implement and suppressing control of the trailing edge of the implement to increase the first angle of approach of the implement, that the position of the leading edge is aligned to the design plan; control the leading edge of the implement and control the trailing edge of the implement to decrease a second angle of approach of the implement based on determining that the position of the leading edge is aligned to the design plan; determine, after controlling the leading edge of the implement and controlling the trailing edge of the implement to decrease the second angle of approach of the implement, that the position of the leading edge and the position of the trailing edge are aligned to the design plan; and control the leading edge of the implement and control the trailing edge of the implement to maintain alignment of the position of the leading edge and the position of the trailing edge to the design plan.

According to some implementations, the present disclosure is related to a machine. The machine may include an articulated implement. The articulated implement may have a leading edge and a trailing edge. The articulated implement may include a first articulation control joint to articulate the leading edge of the articulated implement. The articulated implement may include a second articulation control joint to articulate the trailing edge of the articulated implement. The machine may include a grading control system. The grading control system may be configured to determine, when controlling the first articulation joint and the second articulation joint, a deviation of the articulated implement from the design plan associated with the configured grade of the machine. The grading control system may be configured to suppress control of the second articulation joint. The grading control system may be configured to control, concurrent with suppressing control of the second articulation joint, the first articulation joint to realign the articulated implement with the design plan. The grading control system may be configured to end, after controlling the first articulation joint to realign the articulated implement with the design plan, suppression of control of the second articulation joint.

DETAILED DESCRIPTION

Although some implementations described herein relate to a track-type loader, the implementations apply equally to other types of machines, such as skid-steer loaders, backhoe loaders, wheel loaders, tractors, and/or the like. Moreover, although some implementations described herein relate to a bucket, the implementations apply equally to other types of implements, such as graders, rippers, and/or the like.

Figure 1:
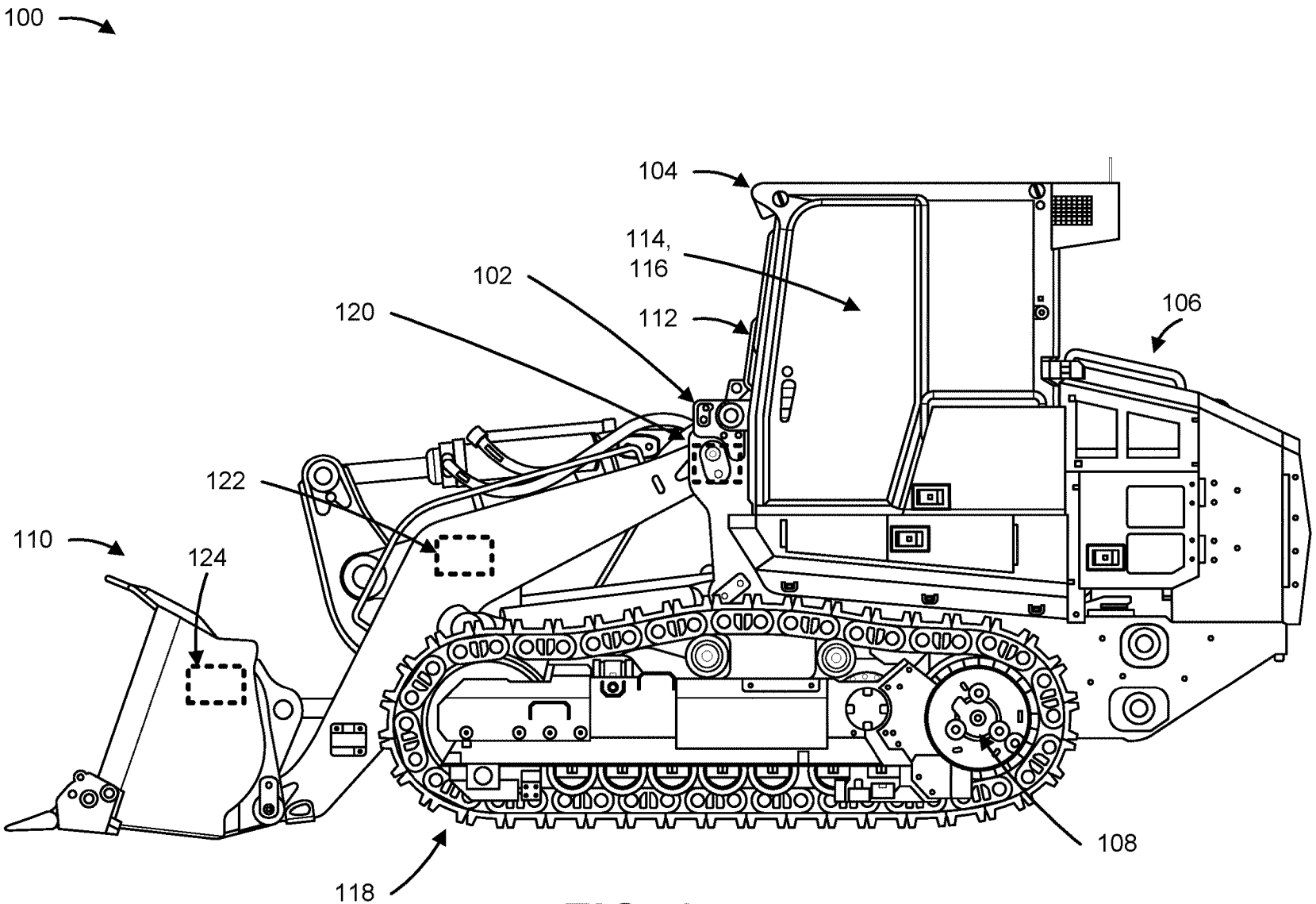
FIG. 1 is diagram of an example machine that includes a grading control system described herein.

FIG. 1 is a diagram of an example machine 100 described herein. The machine 100 is shown as a track-type loader but may include any type of machine.

As shown in FIG. 1, machine 100 may have a frame 102 that supports an operator station 104, a power system 106, a drive system 108, and an implement 110. The operator station 104 may include operator controls 112 for operating the machine 100 via the power system 106. The illustrated operator station 104 is configured to define an interior cabin 114 within which the operator controls 112 are housed and which is accessible via a door 116.

The power system 106 is configured to supply power to the machine 100. The power system 106 may be operably arranged with the operator station 104 to receive control signals from the operator controls 112 in the operator station 104. Additionally, or alternatively, the power system 106 may be operably arranged with the drive system 108 and/or the implement 110 to selectively operate the drive system 108 and/or the implement 110 according to control signals received from the operator controls 112.

The power system 106 may provide operating power for the propulsion of the drive system 108 and/or the operation of the implement 110. The power system 106 may include an engine and a transmission. The engine may be any type of engine suitable for performing work using the machine 100, such as an internal combustion engine, a diesel engine, a gasoline engine, a gaseous fuel-powered engine, a natural gas engine, an electric motor, and/or the like.

The drive system 108 may be operably arranged with the power system 106 to selectively propel the machine 100 in accordance with control signals from the operator controls 112. The drive system 108 can include a plurality of ground-engaging members, such as tracks 118, as shown, which can be movably connected to the frame 102 through axles, drive shafts, and/or other components. In some implementations, the drive system 108 may be provided in the form of a wheel-drive system or any other type of drive system configured to propel the machine 100.

The implement 110 may be operably arranged with the power system 106 such that the implement 110 is articulatable through control signals transmitted from the operator controls 112 and/or a grading control system 120 to the power system 106. The implement 110 may be shown as a bucket. Other embodiments can include any other suitable implement for a variety of tasks. Example implements include loaders and/or the like.

The grading control system 120 may be operably arranged with one or more articulation control modules 122 to control articulation of the implement 110 based on information received from one or more position sensors 124 of a positioning system. For example, the one or more articulation control modules 122 may control a rack/dump function (i.e., a tilt function) of the implement 110, a raise/lower function (i.e., a lift function) of the implement 110, a dig function of the implement 110, and/or the like.

As indicated above, FIG. 1 is provided as an example. Other examples may differ from what was described in connection with FIG. 1.

Figure 2:
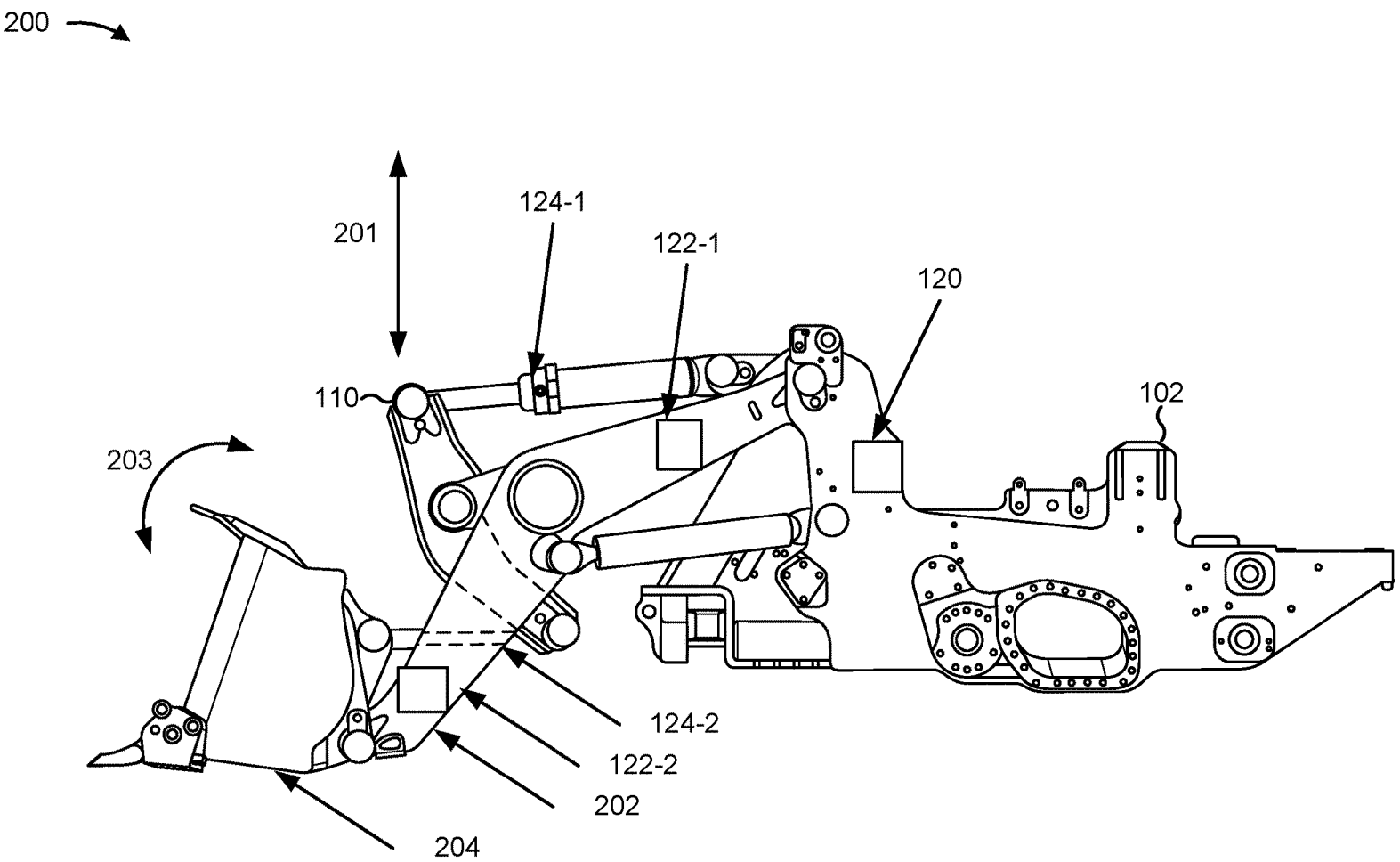
FIG. 2 is a diagram of an example articulated implement that is controlled by a grading control system described herein.

FIG. 2 is a diagram of an example 200 described herein. Example 200 shows the implement 110 attached to the frame 102 of the machine 100.

As shown in FIG. 2, the implement 110 may include a first articulation control module 122-1 and a second articulation control module 122-2, and may include a first position sensor 124-1 and a second position sensor 124-2.

As further shown in FIG. 2, and by reference number 201, the first articulation control module 122-1 may be operably arranged with a lift arm 202 of the implement 110 to control a raise/lower function (i.e., a lift function) of the implement 110. For example, the grading control system 120 may control the first articulation control module 122-1 based on position information from the first position sensor 124-1 to control lift of the implement 110. Similarly, as shown by reference number 203, the second articulation control module 122-2 may be operably arranged with a bucket 204, which may be an end of the implement 110, to control a rack/dump function (i.e., a tilt function) of the implement 110. For example, the grading control system 120 may control the second articulation control module 122-2 based on position information from the second position sensor 124-2 to control tilt of the bucket 204 of the implement 110.

As indicated above, FIG. 2 is provided as an example. Other examples may differ from what was described in connection with FIG. 2.

Figure 3:
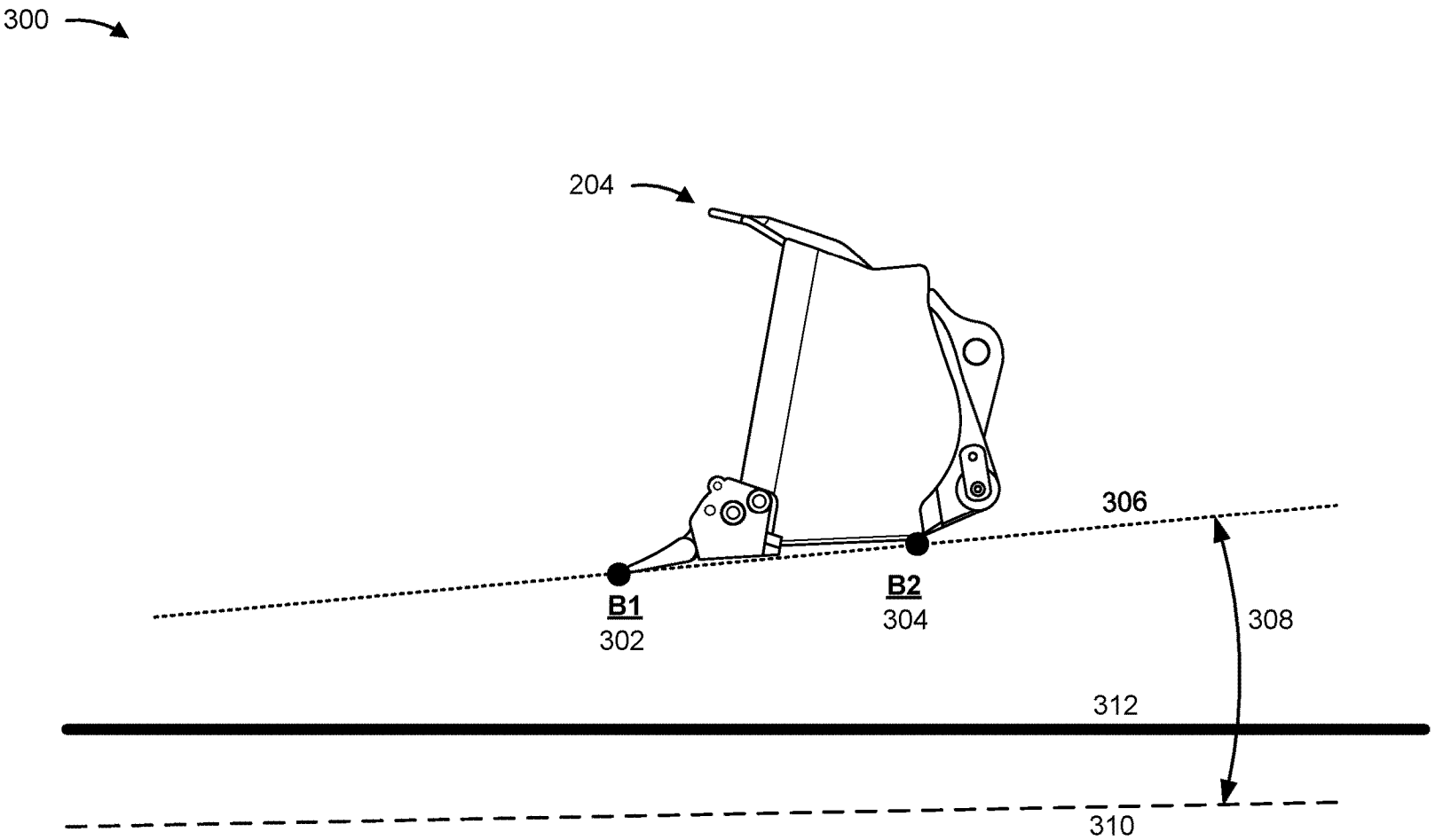
FIG. 3 is diagram of an example bucket that is controlled by a grading control system described herein.

FIG. 3 is a diagram of an example 300 described herein. Example 300 shows a kinematic scheme for the bucket 204.

A leading edge of the bucket 204 (e.g., a position of a cutting edge and/or teeth of the bucket 204) may be defined as a point B1, as shown by reference number 302. Similarly, the trailing edge of the bucket 204 (e.g., a heel of the bucket 204) may be defined as a point B2, as shown by reference number 304. As shown by reference number 306, a bucket plane may be defined by line B1-B2. As shown by reference numbers 308 and 310, an angle of approach may be defined as an angle between the bucket plane and a design plan to which the bucket 204 is configured to align to perform, for example, a grading operation. The design plan may be a grade that the bucket 204 is to grade during the grading operation. As shown by reference number 312, the bucket 204 may be disposed above the design plan, and a ground surface may be disposed between the bucket 204 and the design plan. As a result, a bottom surface of the bucket 204 cannot be lowered to the design plan using the raise/lower control, as described above, and the bucket 204 may be aligned to the design plan using a grading control method described below. As described in more detail herein, the grading control system 120 may tilt the bucket 204 to increase the angle of approach and may suppress control of the lift function of the bucket 204, thereby enabling the leading edge of the bucket 204 to penetrate the ground surface. Once the leading edge of the bucket 204 has reached the grade of the design plan, the grading control system 120 may tilt the bucket 204 to decrease the angle of approach and may stop suppressing the lift function of the bucket 204, thereby enabling the bucket 204 to follow the design plan during the grading operation.

As indicated above, FIG. 3 is provided as an example. Other examples may differ from what was described in connection with FIG. 3.

Figure 4:
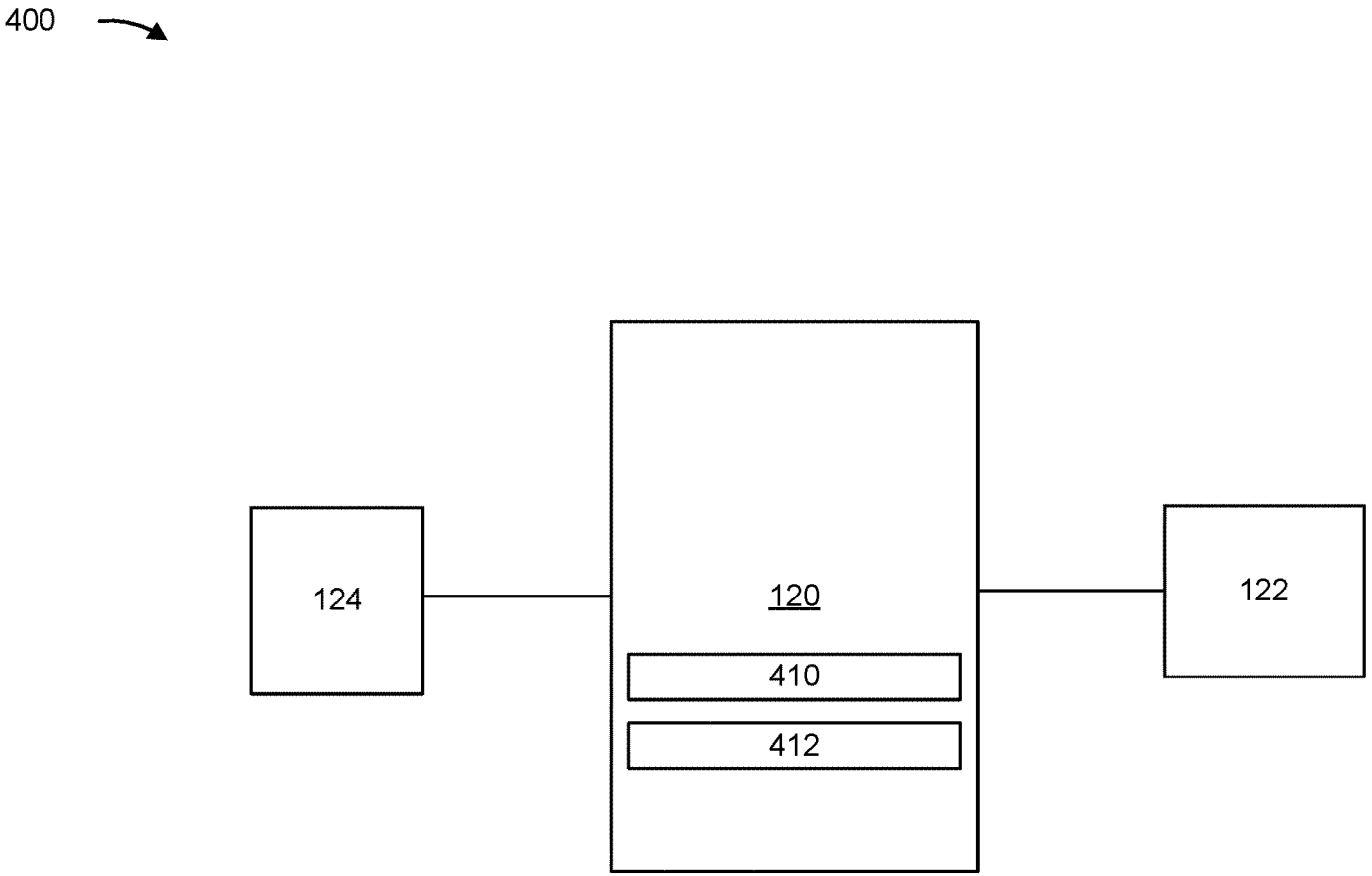
FIG. 4 is a diagram of example components of one or more systems and/or devices described herein.

FIG. 4 is a diagram of an example environment 400 in which systems and/or methods, described herein, may be implemented. As shown in FIG. 4, environment 400 may include the grading control system 120, the articulation control module(s) 122, and the position sensor(s) 124. Devices of environment 400 may interconnect via wired connections, wireless connections, or a combination of wired and wireless connections.

The grading control system 120 includes one or more processors 410 (e.g., a microprocessor, a microcontroller, a field-programmable gate array (FPGA), an application-specific integrated circuit (ASIC), and/or the like) and a memory 412 (e.g., read-only memory (ROM), random-access memory (RAM), and/or the like). In some implementations, the grading control system 120 may be an electronic control unit of the machine 100 and that is configured to control one or more articulation control modules 122. The processor 410 may execute one or more instructions and/or commands to control one or more components of the machine 100, such as to control a set of control loops associated with controlling one or more articulation control modules 122 based on sensor information from one or more position sensors 124. The memory 412 may store program code for execution by the processor 410 and/or for storing data in connection with execution of such program code by the processor 410.

The grading control system 120 may receive one or more input signals from various components of the machine 100, may operate on the one or more input signals using multiple control loops to generate one or more output signals (e.g., by executing a program using the input signals as input to the program), and may output the one or more output signals to various components of the machine 100. For example, the grading control system 120 may receive a set of sensor measurements, such as a location measurement identifying a location of machine 100, a position measurement identifying a position of bucket 204 relative to a design plan, and/or the like. In some implementations, the grading control system 120 may use a kinematic representation of the machine 100 to determine a position of the bucket 204 based on a position of another portion of the machine 100, such as the frame 102, the tracks 118, and/or the like. In this case, the grading control system 120 may transmit a control signal to the one or more articulation control modules 122 to control whether the bucket 204 is tilted and/or lifted to align to the design plan, as described in more detail herein. The one or more articulation control modules 122 may control one or more articulation joints of the machine 100 to adjust a tilt, a lift, and/or the like of the implement 110.

The number and arrangement of devices shown in FIG. 4 are provided as an example. In practice, there may be additional devices, fewer devices, different devices, or differently arranged devices than those shown in FIG. 4. Furthermore, two or more devices shown in FIG. 4 may be implemented within a single device, or a single device shown in FIG. 4 may be implemented as multiple, distributed devices. Additionally, or alternatively, a set of devices (e.g., one or more devices) of environment 400 may perform one or more functions described as being performed by another set of devices of environment 400.

Figure 5:
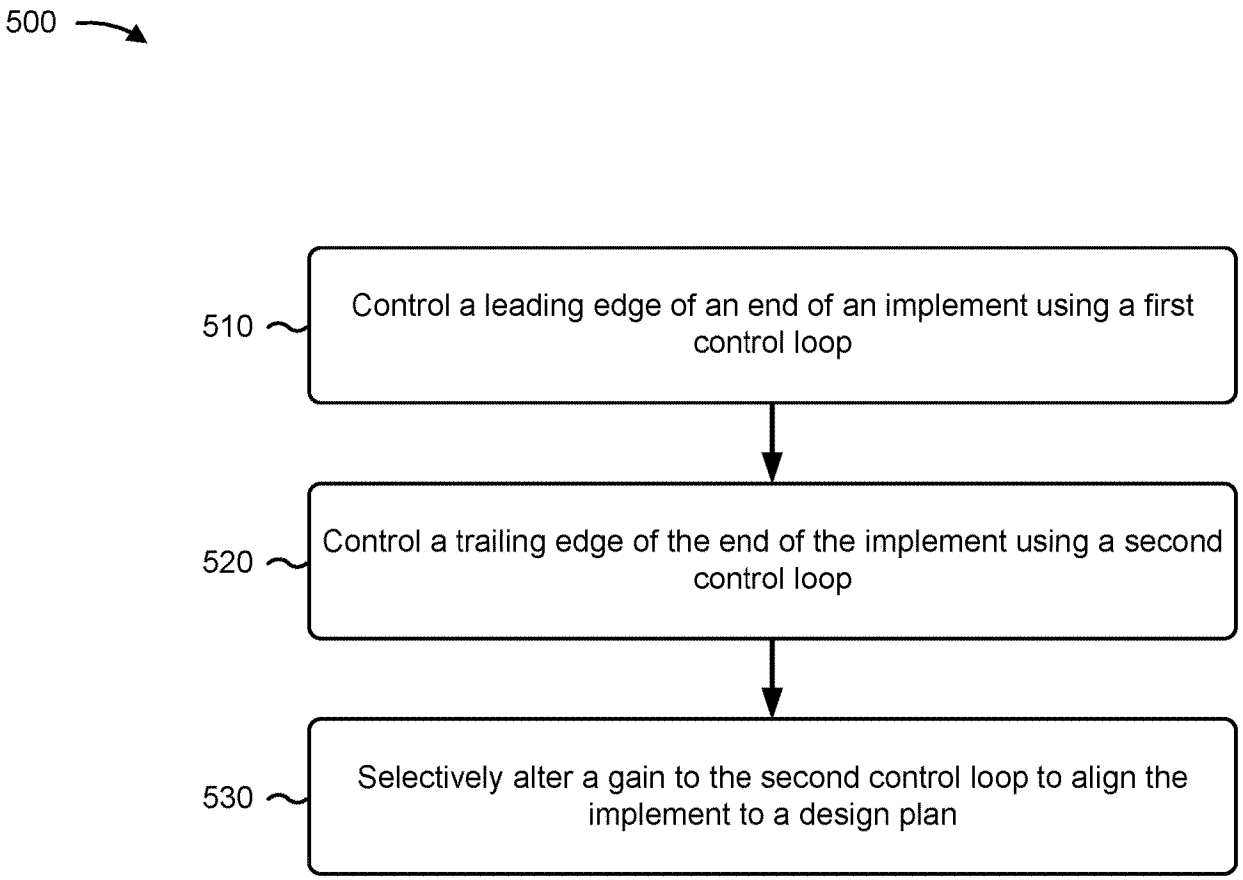
FIG. 5 is a flow chart of an example process for grading control.

FIG. 5 is a flow chart of an example process 500 for grading control. In some implementations, one or more process blocks of FIG. 5 may be performed by a grading control system. In some implementations, one or more process blocks of FIG. 5 may be performed by another device or a group of devices separate from or including the grading control system (e.g., grading control system 120).

As shown in FIG. 5, process 500 may include controlling a leading edge of an end of an implement using a first control loop (block 510). For example, the grading control system (e.g., using processor 410, memory 412, and/or the like) may control a leading edge of a bucket using a first control loop, as described above. The grading control system may determine a position of the leading edge of the implement (e.g., based on information from a position sensor 124), and may control the leading edge of the implement based on the position of the leading edge of the bucket. The grading control system may use the first control loop to adjust a tilt of the bucket to control the leading edge of the implement.

As shown in FIG. 5, process 500 may include controlling a trailing edge of the end of the implement using a second control loop (block 520). For example, the grading control system (e.g., using processor 410, memory 412, and/or the like) may control the trailing edge of the bucket using the second control loop, as described above. The grading control system may determine a position of the trailing edge of the implement (e.g., based on information from a position sensor 124), and may control the trailing edge of the implement based on the position of the leading edge of the implement. The implement may use the second control loop to adjust a lift of the implement to control a position of the trailing edge of the implement.

As shown in FIG. 5, process 500 may include selectively altering a gain to the second control loop to align the implement to a design plan (block 530). For example, the grading control system (e.g., using processor 410, memory 412, and/or the like) may selectively alter the gain to the second control loop to align a bucket to the design plan, as described above. The grading control system may determine that the implement is positioned above the design plan and may suppress the second control loop to cause the implement to move based on the first control loop, thereby causing the implement to tilt toward alignment with the design plan. After suppressing the second control loop, the grading control system may determine that implement is aligned with the design plan (e.g., the leading edge is aligned with the design plan) and may end suppression of the second control loop to enable the implement to grade in accordance with the design plan.

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

INDUSTRIAL APPLICABILITY

The disclosed grading control system (e.g., the grading control system 120) may be used with any machine where a technique for grading control is desirable. The disclosed grading control system may use two independent closed loop control loops to control tilt, and lift, respectively. The disclosed grading control system may use a first control loop to maintain a position of a first point, B1, associated with a leading edge of the bucket on a grade of a design plan. The disclosed grading control system may use a second control loop to maintain a position of a second point, B2, associated with a trailing edge of the bucket on the grade of the design plan.

The disclosed grading control system may compare a first position of B1 with a second position of B2 to determine the position of the bucket relative to the design plan and/or a design plan error representing a deviation of the bucket from a grade associated with the design plan. When points B1 and B2 are disposed above the design plan, the disclosed grading control system may suppress the second control loop. The disclosed grading control system may suppress the second control loop by decreasing a gain to signals associated with the second control loop. In this case, the disclosed grading control system may cause the first control loop to tilt the bucket toward the design plan (e.g., by providing a dump command to an articulation control module of the bucket) rather than lowering the bucket toward the design plan using lift control. For example, the bucket may use the first control loop to increase an angle of approach toward the design plan, thereby enabling the bucket to penetrate the ground toward the design plan and to move the bucket such that B1 reaches a grade of the design plan. In this way, the disclosed grading control system improves control of the bucket relative to lowering the bucket using the lift control (which may be prevented from reaching the design plan by a surface of the ground).

Further, the disclosed grading control system may determine that the bucket has aligned to the design plan (e.g., when point B1 is aligned to the design plan). In this case, the disclosed grading control system may use the first control loop to tilt the bucket to cause B2 to be aligned to the design plan (e.g., by decreasing the angle of approach to return the bucket to a flat position relatively parallel to the design plan). After, the disclosed grading control system may end suppression of the second control loop, which may enable the bucket to follow the design plan during a grading operation by using both the tilt control and the lift control.

What is claimed is:

1. A method, comprising:

controlling, by a device, a leading edge of an implement of a machine and controlling a trailing edge of the implement to cause the implement to align to a defined design plan; and selectively altering, by the device, a gain based on a detected deviation of the implement from the defined design plan to increase an angle of approach when the implement is positioned above the defined design plan and decrease the angle of approach when the implement is aligned to the defined design plan.

2. The method of claim 1, further comprising:

determining a position of the leading edge of the implement; and wherein controlling the leading edge of the implement comprises:

controlling the leading edge of the implement based on the position of the leading edge of the implement.

3. The method of claim 1, further comprising:

determining a position of the trailing edge of the implement; and wherein controlling the trailing edge of the implement comprises:

controlling the trailing edge of the implement based on the position of the trailing edge of the implement.

4. The method of claim 1, further comprising:

comparing a first position of the leading edge of the implement and a second position of the trailing edge of the implement to the design plan;

determining a design plan error based on comparing the first position of the leading edge of the implement and the second position of the trailing edge of the implement to the design plan; and controlling the leading edge of the implement and the trailing edge of the implement based on the design plan error.

5. The method of claim 1, wherein controlling the leading edge of the implement comprises controlling a tilt of the implement.

6. The method of claim 1, controlling the trailing edge of the implement comprises controlling a lift of the implement.

7. The method of claim 1, further comprising:

determining that the implement is positioned above the design plan; and wherein selectively altering the gain comprises:

suppressing control of the trailing edge to cause the implement to move based on controlling the leading edge and based on determining that the implement is positioned above the design plan.

8. The method of claim 7, further comprising:

determining, after suppressing the control of the trailing edge and after moving the implement based on controlling the leading edge, that the implement is aligned with the design plan; and ending suppression of the control of the trailing edge to cause the implement to be moved based on both controlling the leading edge and controlling the trailing edge.

9. A system, comprising:

one or more memories; and one or more processors communicatively coupled to the one or more memories, configured to:

determine a position of a leading edge of an implement of a machine;

determine a position of a trailing edge of the implement;

determine, based on the position of the leading edge and the position of the trailing edge, a deviation from a design plan defining a grade for the implement;

control the leading edge of the implement and suppress control of the trailing edge of the implement to increase a first angle of approach of the implement;

determine, after controlling the leading edge of the implement and suppressing control of the trailing edge of the implement to increase the first angle of approach of the implement, that the position of the leading edge is aligned to the design plan;

control the leading edge of the implement and control the trailing edge of the implement to decrease a second angle of approach of the implement based on determining that the position of the leading edge is aligned to the design plan;

determine, after controlling the leading edge of the implement and controlling the trailing edge of the implement to decrease the second angle of approach of the implement, that the position of the leading edge and the position of the trailing edge are aligned to the design plan; and control the leading edge of the implement and control the trailing edge of the implement to maintain alignment of the position of the leading edge and the position of the trailing edge to the design plan.

10. The system of claim 9, wherein the one or more processors are further configured to:

alter a gain to suppress control of the trailing edge of the implement.

11. The system of claim 9, wherein the one or more processors, when controlling the leading edge of the implement and suppressing control of the trailing edge of the implement, are to:

control a tilt of the implement and suppress control of a lift of the implement.

12. The system of claim 9, wherein the one or more processors, when determining the position of the leading edge, are to:

determine the position of the leading edge based at least one of:

one or more sensor measurements, or a kinematic representation of the machine.

13. The system of claim 9, wherein the one or more processors, when determining the position of the trailing edge, are to:

determine the position of the trailing edge based on at least one of:

one or more sensor measurements, or a kinematic representation of the machine.

14. A machine, comprising:

an articulated implement, comprising:

the articulated implement comprising a leading edge and a trailing edge;

a first articulation control joint to articulate the leading edge, a second articulation control joint to articulate the trailing edge; and a grading control system, configured to:

control the first articulation joint and the second articulation joint to maintain alignment of an angle of approach of the articulated implement with a design plan associated with a configured grade of the machine;

determine, when controlling the first articulation joint and the second articulation joint, a deviation of the articulated implement from the design plan associated with the configured grade of the machine;

suppress control of the second articulation joint;

control, concurrent with suppressing control of the second articulation joint, the first articulation joint to realign the articulated implement with the design plan; and end, after controlling the first articulation joint to realign the articulated implement with the design plan, suppression of control of the second articulation joint.

15. The machine of claim 14, further comprising:

one or more sensors to determine a position of the articulated implement relative to the design plan associated with the configured grade of the machine.

16. The machine of claim 14, the grading control system, when configured to control the first articulation joint to realign the articulated implement with the design plan, is configured to:

transmit a dump command to the first articulation joint to increase an angle of approach of the articulated implement; and transmit a dig command to another articulation joint to cause the articulated implement to dig into a surface.

17. The machine of claim 14, further comprising:

a positioning system to determine a position of the machine; and wherein the grading control system is configured to determine the design plan based on the position of the machine.

18. The method of claim 1, further comprising:

determining the defined design plan based on a position of the machine.

19. The method of claim 1, wherein determining the position of the leading edge comprises:

determining the position of the leading edge based on a kinematic representation of the machine.

20. The system of claim 9, wherein the one or more processors are further configured to:

determine the design plan based on a position of the machine.

* * * * *